US005591110A

United States Patent [19]

Weissbuch

[11] Patent Number: 5,591,110

[45] Date of Patent: Jan. 7, 1997

[54] MULTI-PURPOSE FLEXIBLE REVERSIBLE RESISTANCE ELEMENT FOR EXERCISE DEVICES

[76] Inventor: Sanford S. Weissbuch, 2276 S. Beverly Glen Blvd., Los Angeles, Calif. 90064

[21] Appl. No.: 397,379

[22] Filed: Mar. 2, 1995

[51] Int. Cl.[6] ..... A63B 21/008

[52] U.S. Cl. ..... 482/111; 482/92; 482/133

[58] Field of Search ..... 482/92, 111, 133; 4/255.11, 255.05; 43/11

[56] References Cited

U.S. PATENT DOCUMENTS

| | | | |
|---|---|---|---|
| D. 169,246 | 4/1953 | Eisenberg . | |
| 675,314 | 5/1901 | Abenheim . | |
| 1,065,307 | 6/1913 | Evertts | 4/255.11 |
| 2,825,069 | 3/1958 | Jorgensen et al. . | |
| 3,130,421 | 4/1964 | Quinlan | 4/255.11 |
| 3,427,020 | 2/1969 | Montour et al. . | |
| 4,063,380 | 12/1977 | Grim | 43/11 |
| 4,300,759 | 11/1981 | Caplan . | |
| 4,311,306 | 1/1982 | Solloway . | |
| 4,416,451 | 11/1983 | Solloway . | |
| 4,480,829 | 11/1984 | Yacoboski . | |
| 4,575,075 | 3/1986 | Tarbox et al. . | |
| 4,603,854 | 8/1986 | Krausz . | |
| 4,623,142 | 11/1986 | MacKechnie . | |
| 4,721,300 | 1/1988 | Guzman . | |
| 4,768,774 | 9/1988 | Beasley . | |
| 4,813,668 | 3/1989 | Solloway . | |
| 4,819,951 | 4/1989 | Solloway . | |
| 4,905,991 | 3/1990 | Alston . | |
| 4,951,940 | 8/1990 | Vitello et al. . | |
| 4,988,094 | 1/1991 | Beasley . | |
| 4,997,183 | 3/1991 | Winston . | |
| 5,031,904 | 7/1991 | Solloway . | |
| 5,033,739 | 7/1991 | MacKechnie . | |
| 5,102,120 | 4/1992 | Lindblad . | |
| 5,169,371 | 12/1992 | Holmes . | |
| 5,184,993 | 2/1993 | Dowdeswell . | |

*Primary Examiner*—Lynne A. Reichard

*Attorney, Agent, or Firm*—Merchant, Gould, Smith, Edell, Welter & Schmidt

[57] ABSTRACT

A device comprises a support, and at least one flexible substantially cup-shaped element operatively connected to the support. The element includes a base, a rim and a first axis extending from the center of the base to the center of an area enclosed by the rim. It is reversible about an axis perpendicular to said first axis without being removed from the support. It is operable for a first function in a first position and a second function in a reversed position. The reversible cup-like shaped elements are selectively locatable with the support in multiple operational modes with the rim of the flexible and reversible elements directed differently relative to the element. This can be with the rim of the flexible and reversible elements directed substantially away from the support, or with the rim of some of the flexible and reversible elements directed substantially toward the support and the rim of other flexible and reversible elements directed substantially away from the support. The device is usable as a variable reaction exercising device, a door stop, a walking aid, a device for braking and steering a vessel in fluid, and a scooping device.

25 Claims, 6 Drawing Sheets

MULTI-PURPOSE FLEXIBLE REVERSIBLE RESISTANCE ELEMENT FOR EXERCISE DEVICES

RELATED APPLICATION

This invention relates to application Ser. No. 08/116,861 filed Sept. 2, 1993. The contents of that application are incorporated by reference herein.

BACKGROUND

There is a need for a multi-purpose reaction variable device which can be used for different applications.

This invention is related to variable reaction exercising devices, walking aids, steering means, braking means, door stops and the like. In particular, the invention is directed to providing means for providing for an enhanced application to such devices by using a multi-functional flexible reversible device.

An aquatic exercising device that can provide for adjustable resistance through water is highly desirable. One aspect of this invention relates to an aquatic exercising device.

In particular, the device can be adjusted to provide for multi-directional varied resistance whereby the exercising effect for the user can be varied as desired.

Aquatic exercising is highly desirable for improving the muscular tone and cardiovascular system. Exercising in water is advantageous since the body is cool and movements are relatively smooth, thereby minimizing the chance of injury due to jarring. Moreover, water increases the general resistance and effort needed to move in any direction.

Different devices are known for facilitating aquatic exercising. In the Applicant's experience, such devices are relatively complex. They are difficult to adjust, relatively complex in construction and cumbersome for carrying, especially when not in use.

There is a need to have an aquatic exercising device which minimizes the disadvantages of known devices.

In other aspects of the invention, the reversible aspects of the reaction varying device has multiple other applications. Also, there are many other uses for the reversible flexible device.

SUMMARY

The present invention is directed to minimizing the disadvantages of known aquatic exercising devices. The invention is also directed to providing a device using a variable flexible reversible element to provide useful applications in steering, braking, and interaction with other surfaces.

According to the invention, there is provided a multi-purpose flexible reversible variable reaction device which comprises a support, and a flexible substantially cup-shaped element operatively connected to the support. The element includes a base, a rim and a first axis extending from the center of the base to the center of an area enclosed by the rim. The element is configured to be reversible about an axis perpendicular to said first axis without being removed from the support, and to be operable for a first function in a first position and a second function in a reversed position.

The support further includes a first end and a second end, and there are multiple flexible elements. Each respective element is affixed operatively and reversibly to the support.

There are also included means for having the flexible and reversible cup-like shaped elements selectively locatable with the support in multiple operational modes. The modes are firstly with the rim of the flexible and reversible elements directed substantially toward the element. Secondly, the mode is with the rim of the flexible and reversible elements directed substantially away from the support. Thirdly, the rim of some of the flexible and reversible elements are directed substantially toward the support and the rim of other flexible and reversible elements directed substantially away from the support.

The element is operable for a first function in a first position and a second function in a reversed position. The element in the first position extends with the rim directed away from the support thereby to provide a first resistance to an engaging medium when the element moves relatively through the medium. The element in the second position extends with the rim directed towards the support thereby to provide a second resistance to an engaging medium when the element moves relatively through the medium.

The medium is selectively a liquid or a gas. The multiple modes of the multiple elements act to permit different modes of interaction of the support with the medium. The different modes of interaction are selectively braking or steering of the support in the medium.

In one preferred form of the invention, the device is an aquatic exercising device, and the elements are reversible hydro-resistive elements for operation in selectively different reversible positions about their respective axes.

In some forms of the aquatic exercising device, there is a pivot element fixed for location with the support between a stirrup or hand gripping element and the element. The stirrup or hand gripping element includes means for receiving a foot or hand respectively. There is also a foundation member for locating the device on a floor or wall of a water containing vessel.

In other forms of the aquatic exercising device, the support can be a foot-receiving platform, and the device can be a form of ski or board.

In other forms of the aquatic exercising device, there are foot-receiving stirrup elements operatively connected to the support. There is an axle element for location with the support and between the stirrup elements so that the support is rotatable about the axle under action of foot power in the stirrup elements.

The support includes multiple limbs, and there are multiple flexible elements, each respective reversible element being operatively and reversibly connected to the support.

In yet a different form of the aquatic exercising device, there is a foundation element connected to an end of the support. The handle may be gripped in the hand between the foundation element and the hydro-resistive element.

In a different aspect of the invention, there is provided a support and a flexible, substantially cup-shaped reversible element operatively connected to the support. The support includes a rotatable element at an end-receiving the cup-shaped element.

In a first functioning position, the cup-shaped element effectively covers the rotatable element thereby to prevent interaction of the rotatable element with a foundation. In a second functioning position, the cup-shaped element effectively uncovers the rotatable element thereby to permit interaction of the rotatable element with a foundation. The support is selectively a leg for a chair, furniture, walker, or a stick for a walking aid.

In yet a further form of the invention, the device comprises a support and a flexible substantially cup-shaped element operatively connected to the support. It is operable for a first function in a first position and a second function in a reversed position. The element is a scooping element such that in a first functioning position the element effectively permits a scooping action with a floor, and in a second position scooping action with the floor is prevented. There is included a cover element, and in a second functioning position, the cover element effectively uncovers the reversible scooping element thereby to permit interaction of the scooping element with the floor. The support is a stick for a pooper scooper and the scooping element is for scooping poop.

A further feature of the invention is as a door stop, or furniture leg end piece. There is a support, and a flexible substantially reversible cup-shaped element operatively connected to the support. In a first functioning position, the element effectively permits engagement with an engaging surface as a door stop or furniture end piece. In a second functioning position, the element effectively permits a suction engagement with an engaging surface such as a door, wall or floor. In the second functioning position, the device acts as a door holder, or furniture position stabilizer.

The invention is further described with reference to the accompanying drawings.

DRAWINGS

Figure 7A:
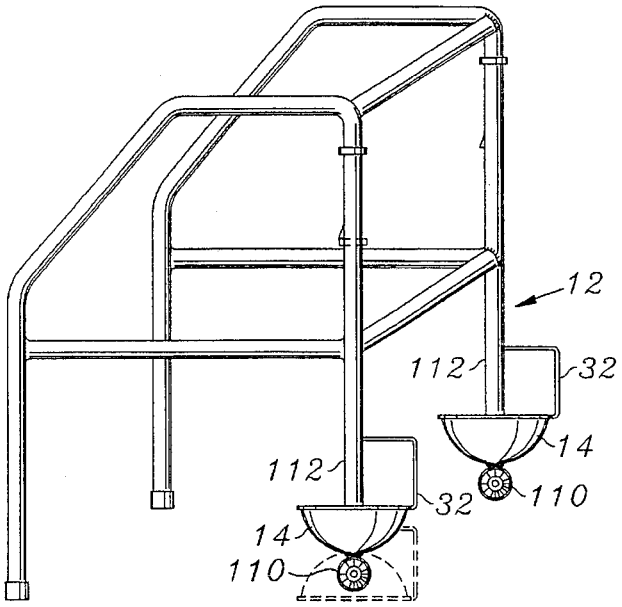

FIG. 7*a* is a view of a device with a support, a flexible substantially cup-shaped element operatively connected to the support, and a rotatable element at an end receiving the element. The cup selectively covers or uncovers the rotatable element thereby to prevent interaction of the rotatable element with a foundation.

Figure 7B:
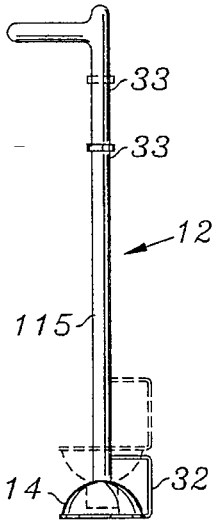

FIG. 7*b* is a view of a walking stick and cup-shaped element without a roller element.

Figure 8:
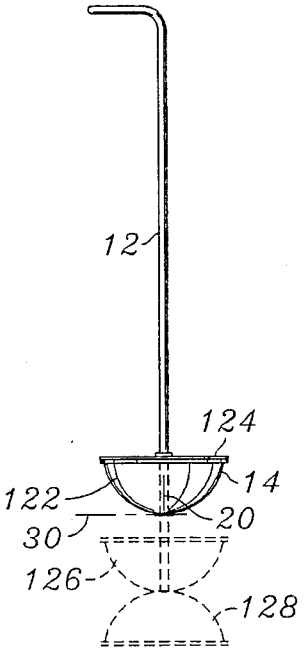

FIG. 8 is a view of a scooping device with a support and a flexible substantially cup-shaped element operatively connected to the support. The element can effectively scoop with a floor or be prevented from a scooping action with the floor, or permit emptying.

Figure 9:
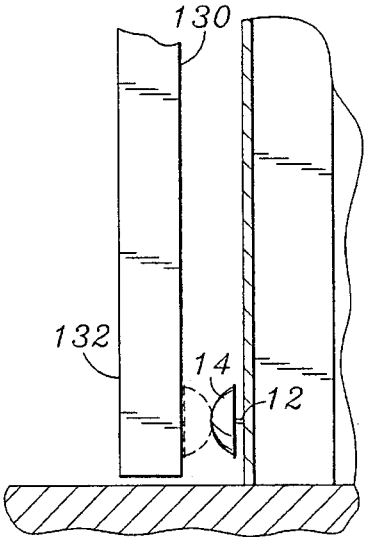

FIG. 9 is a view of a door stop and holder device where there is selectively engagement or non-engagement with a door engaging surface.

Figure 10:
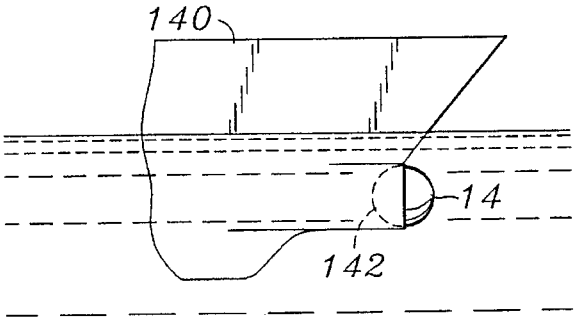

FIG. 10 is a view of a boat with the reversible element in the hull.

Figure 11:
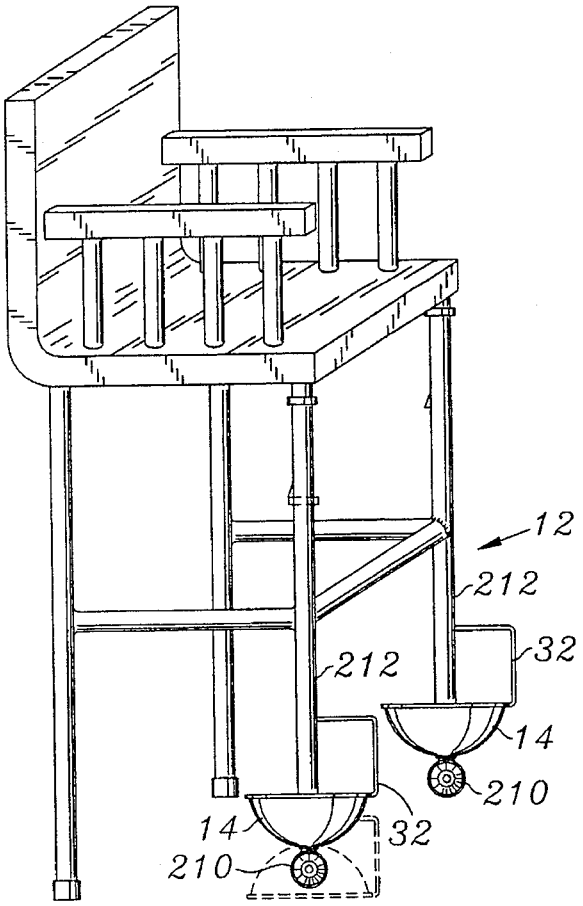

FIG. 11 is a view of furniture, namely a high chair, using the device for regulating movement of the legs on a floor.

Figure 12:
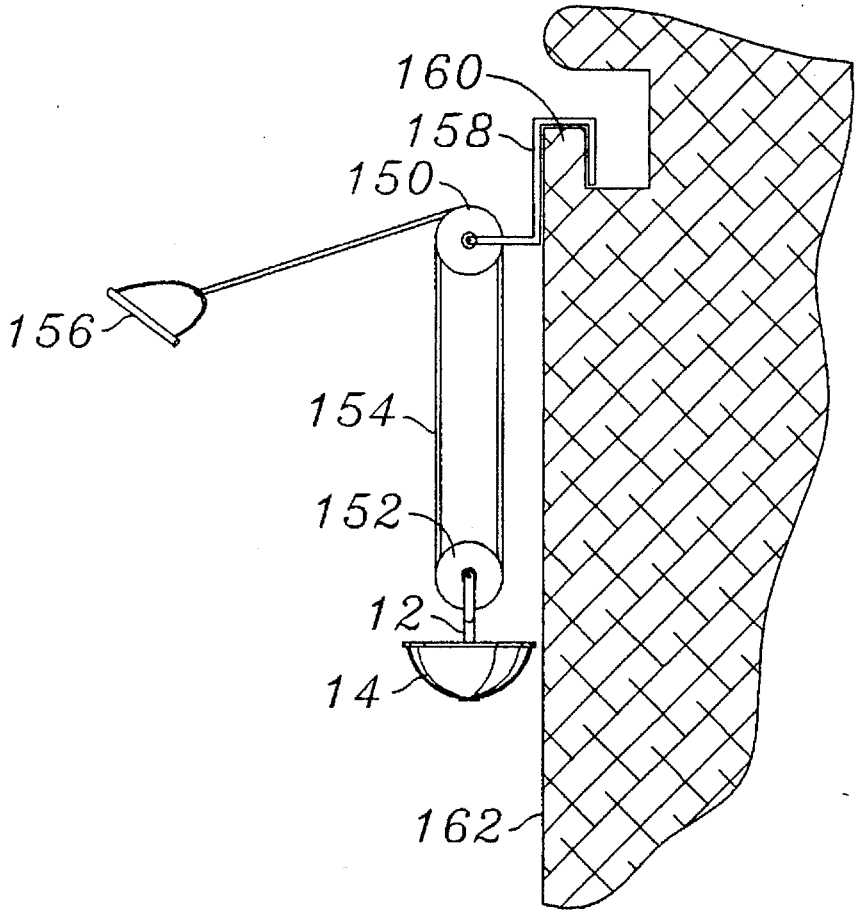

FIG. 12 is a view of a stirrup and pulley device or exercising.

Figure 13A:
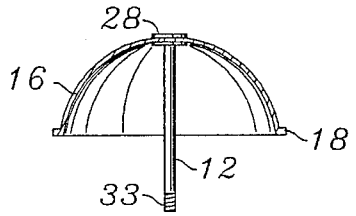

FIG. 13*a* is a view of one basic format of the device using a configuration of a reversible and flexible element mounted with a support, the element being reversible about the base of the element.

Figure 13B:
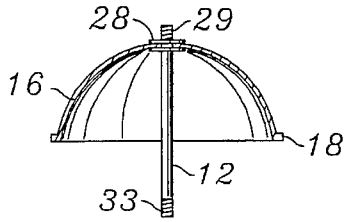

FIG. 13*b* is a view of another basic format of the device using a configuration of a reversible and flexible element mounted with a support, the element being reversible about the base of the element, and the support having attachment means such as an appendage which can be used for interaction with a surface or for mounting a tool, implement, or other interactive device.

Figure 13C:
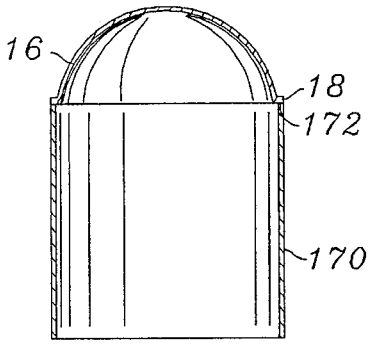

FIG. 13*c* is a view of another basic format of the device using a configuration of a reversible and flexible element mounted with a circumferential support, the element being reversible about the rim of the flexible element and the circumferential support.

Figure 13D:
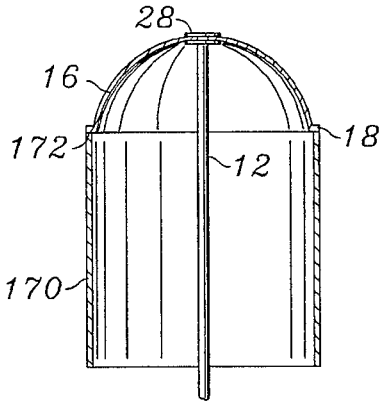

FIG. 13*d* is a view of another basic format of the device using a configuration of a reversible and flexible element mounted with a circumferential support, the element being reversible about the rim of the flexible element and the circumferential support, and there being a support attached to the base of the flexible element.

Figure 13E:
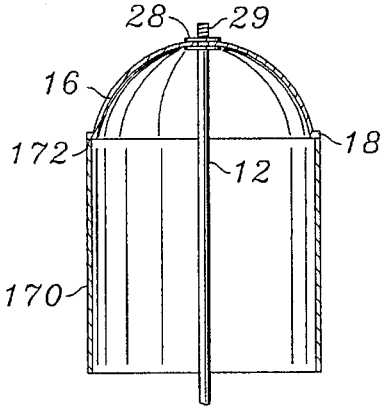

FIG. 13*e* is a view of another basic format of the device using a configuration of a reversible and flexible element mounted with a support, the element being reversible about the rim of the flexible element, and the support having attachment means such as an appendage which can be used for interaction with a surface or for mounting a tool, implement, or other interactive device.

DESCRIPTION

Figure 1:
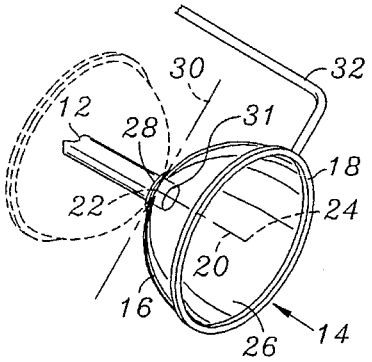
FIG. 1 is a view of a multi-purpose flexible reversible variable reaction device with a support and a flexible substantially cup-shaped element operatively connected to the support.

In FIG. 1, for example, there is shown a reversible variable reaction device comprises a support 12, and a flexible substantially cup-shaped element 14 operatively connected to the support 12. The element 14 including a base 16, a rim 18 and a first axis 20 extending from the center 24 of the base 16 to the center 24 of an area 26 enclosed by the rim 18. The element 14 is configured to be reversible about an axis 30 perpendicular to said first axis 20 without being removed from the support 12. The element 14 is operable for a first function in a first position and a second function in a reversed position.

In general principles, there are some basic operating characteristics of the device of the invention. These are illustrated differently in FIGS. 13*a* to 13*e*. In FIG. 13*a* there is a support 12 which engages flexible cup 14 at the center of the base 16. There is no appendage from the support 12, and the cup is flexibly reversible. In the arrangement of FIG.

13*b*, there is an appendage 29 from the support 12, the appendage 29 being for engagement or interaction with surface or being for affixing a device such as a wheel. In FIG. 13*c* the flexible cup 14 is supported circumferentially 172 at the rim 18 and is reversible about the circumference 172. In FIG. 13*d*, there are both the support 12 at the base 28 and the circumferential periphery 172. In FIGS. 13*c* to 13*e*, the support is a peripheral cylindrical wall 170. In FIG. 13*e*, there is an arrangement similar to FIG. 13*d* and additionally an appendage 29.

Figure 5:
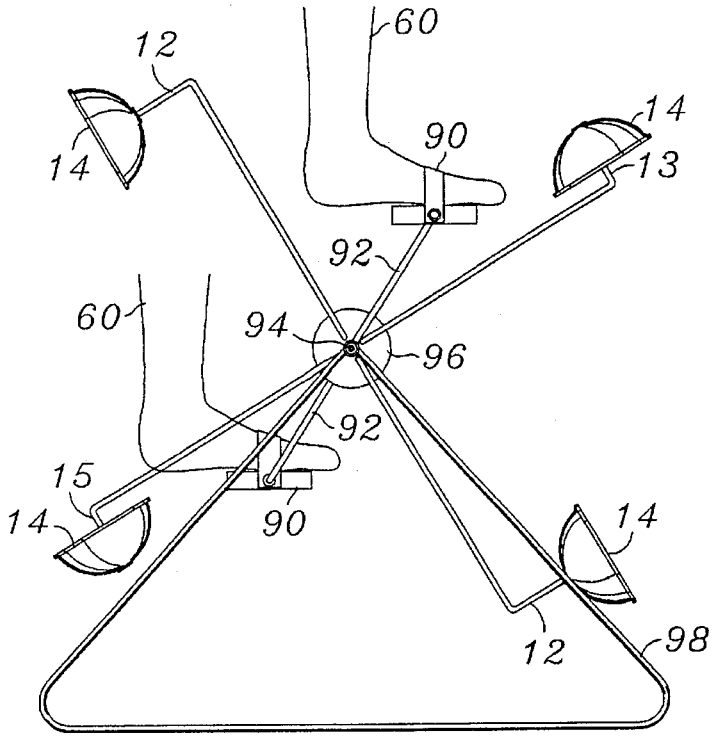
FIG. 5 is a view of an aquatic exercising device comprising multiple flexible substantially cup-shaped hydro-resistive elements operatively connected to the ends of the support where each element moves relatively through a medium. There are foot receiving stirrup elements operatively connected to the support, and an axle element for location with the support and between the stirrup elements.

There can be multiple flexible elements 14, for instance two respective elements 14 affixed operatively and reversibly to the support 12, as illustrated in FIG. 5. Each flexible element 14 includes a radial member 31, the radial member 31 being directed substantially along part of the first axis 20 for the cup-like shaped element 14, and the radial member 31 being for anchoring engagement with the support 12.

There are means 32 for having the flexible and reversible cup-like shaped elements 14 selectively locatable with the support 12 in multiple operational modes. The modes are with the rim 18 of the flexible and reversible elements 18 directed substantially toward the support 12. The rim 18 of the flexible and reversible elements 14 directed substantially away from the support 12, or with the rim 18 of some of the flexible and reversible elements 14 directed substantially toward the support and the rim 18 of other flexible and reversible elements 14 directed substantially away from the support 12.

As an aquatic exercise device, there is a support 12, a flexible substantially cup-shaped element 14 operatively connected to the support 12. The element 14 includes a base, a rim and a first axis extending from the center 28 of the base 16 to the center of an area enclosed by the rim 18 and being configured to be reversible about an axis 30 perpendicular to said first axis 20 without being removed from the support. It is operable for a first function in a first position and a second function in a reversed position.

The element 14 in a the first position extends with the rim directed away from the support 12 thereby to provide a first resistance to an engaging medium when the element 14 moves relatively through the medium. The element 14 in a second position extends with the rim 18 directed towards the support 12 thereby to provide a second resistance to an engaging medium when the element moves relatively through the medium. The medium is selectively a liquid or a gas.

Figure 3:
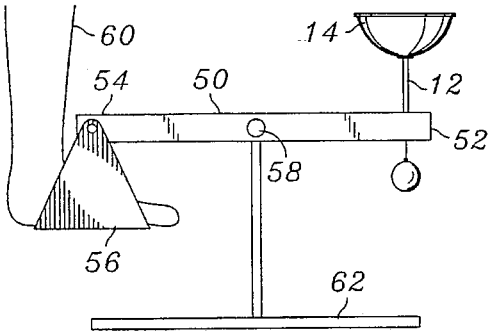
FIG. 3 is a view of an aquatic exercising device using a support having a first end and a second end, a flexible and reversible about a first axis hydro-resistive element operatively connected to the first end of the support, and a stirrup element operatively connected to the second end of the support.

In a different embodiment of the invention as illustrated in FIG. 3, as an aquatic device there is a support 50 having a first end 52 and a second end 54. A flexible and reversible hydro-resistive element 14 is operatively connected with the support 12 to the first end 52 with support 12.

A stirrup element 56 is operatively connected to the second end 54 of the support 50. There is a pivot element 58 fixed for location with the support 50 between the stirrup 56 and the element 14. The stirrup 56 includes means for receiving a foot 60. There are further means including a foundation member 62 for locating the device on a floor of a water containing vessel or pool.

Figure 4:
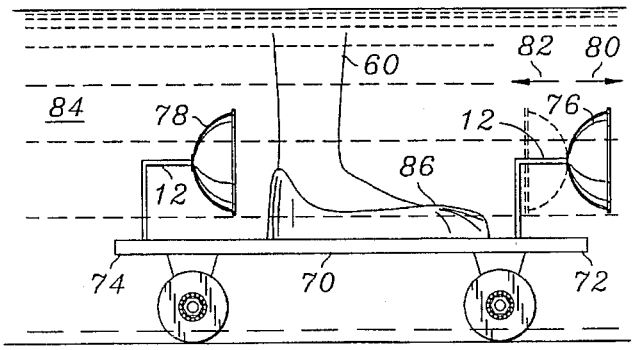
FIG. 4 is a view of a different aquatic exercising device. There is a first flexible substantially cup-shaped hydro-resistive element operatively connected to the first end of the support, and a second flexible substantially cup-shaped hydro-resistive element operatively connected to the second end of the support.

Another aquatic exercising device, as illustrated in FIG. 4, comprises a platform 70 having a first end 72 and a second end 74. The platform 70 has a foot holding element 86 in which a foot 60 is placed. A first flexible substantially cup-shaped hydro-resistive element 76 operatively connected to the first end of the platform 70. A second flexible substantially cup-shaped hydro-resistive element 78 is operatively connected to the second end 74 of the platform 70. The elements 76 and 78 in a the first position extend with the rim 18 protruding in a first direction 80 relative to the support 12 thereby to provide a first resistance to an engaging medium 84 when the element moves relatively through the medium 84. The second position extends with the rim 18 directed differently relative to the support 12 thereby to provide a second resistance to an engaging medium when each element 14 moves relatively through the medium 84. The medium is selectively a liquid or a gas.

In yet a further form, as illustrated in FIG. 5, the device includes foot receiving stirrup elements 90 operatively connected to the arms 92. There is an axle element 94 for location with the arms 92 and between the stirrup elements 90 so that the arms 92 are rotatable about the axle 94 under action of foot power in the stirrup elements 90. There are multiple supports 12 which each include a first end 13 and a second end 15. There are multiple flexible elements 14, each respective element 14 being affixed operatively and reversibly to the supports 12 at the ends 13 and 15. This device is supported on a frame 98 can be used to cycle in water, and the reversal of the cups 14 can vary the resistance, as required.

Figure 6:
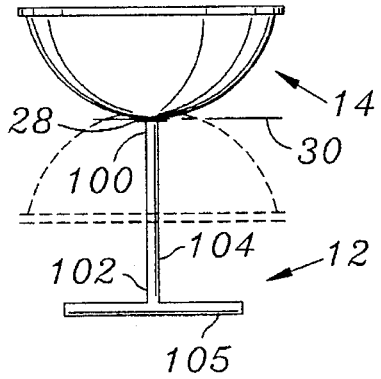
FIG. 6 is a view of an aquatic exercising device with a handle, a flexible and reversible about a first axis hydro-resistive element, and a foundation element connected to the second end of the handle.

In another aquatic exercising device, as illustrated in FIG. 6, there is a handle or support 104 having a first end 100 and a second end 102. There is a flexible and reversible hydro-resistive element 14 operatively connected to the first end 100 of the handle 104. A foundation element 105 is connected to the second end of the handle 102 so that the handle 104 may be gripped in the hand between the foundation element 105 and the hydro-resistive element 14. The flexible and reversible hydro-resistive element 14 can be positioned in selectively different reversible positions about its axis 30 relative to the handle 104. The different positions are attained without removal of the flexible and reversible hydro-resistive element 14 from the handle 104. The hydro-resistive element 14 is operable for a first function in a first position and a second function in a reversed position. The element 14 in a first position extends with the rim 18 from the handle 104 thereby to provide a first resistance to water when the element moves relatively through the water. The element 14 in a second position extends with the rim 18 retracted towards the handle 104 thereby to provide a second resistance to the water when the element 14 moves relatively through the water.

In a different form of the invented device, as illustrated in FIGS. 7*a* and 7*b*, there is a support 115, and a flexible substantially cup-shaped element 14 operatively connected to the support 115. In a first functioning position the element 14 effectively covers a rotatable element 110 thereby to prevent interaction of the rotatable element 110 with a foundation. In a second functioning position, the element 14 effectively uncovers the rotatable element 110 thereby to permit interaction of the rotatable element 110 with the foundation, ground or floor. The support is one or more legs 112 for a walker.

In a different form as illustrated in FIG. 7*b*, the support is a stick 115 for a walking aid. An operating ring 33 movable between different positions and connected by a bar to the operating means 32 moves the elements 14 as required.

Another aspect of the invention is as a scooper device, as illustrated in FIG. 8. There is a support 12, and a flexible substantially cup-shaped element 14 operatively connected to the support 12. The element 14 includes a base, a rim, and a first axis extending from the center of the base to the center of an area enclosed by the rim. The element 14 is configured to be reversible about an axis perpendicular to said first axis 20 without being removed from the support 12. It is operable for a first function in a first position and a second function in a reversed position. The element 14 is a scooping element.

As such, in a first functioning position 126, the element 14 effectively permits a scooping action with the ground. In the reversed position 128 scooping action with the ground is prevented, and in fact the reversed position permits the element 14 to be emptied. As such, the support 12 is a stick for a pooper scooper and the scooping element 14 is for scooping poop.

There is also a cover element 124. In a third retracted position 122 the element 14 is covered so that no scooping or emptying is possible. In the positions 126 and 128, the cover element 124 is effectively separated from the reversible scooping element 14 thereby to permit interaction of the scooping element 14 with the floor, or emptying or cleaning of the element 14.

A further function of the device is illustrated in FIG. 9 as a door stop and holder. The device includes a support 12, and a flexible substantially cup-shaped element 14 operatively connected to the support 12. In a first functioning position, the element 14 effectively permits a bumper-like engagement with an engaging surface 130 and in a second functioning position the element effectively permits a suction engagement with an engaging surface 130. The device acts as a door stop in the first functioning position. It acts as a door holder in the second functioning position. The surface 130 of a door 132 is the engaging surface 130.

Many other forms of the invention exist each differing from others in matters of detail only.

Figure 2:
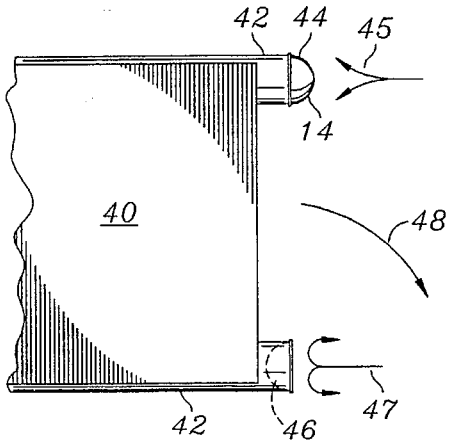
FIG. 2 is a view of a device for moving in, through or relative to a fluid medium, such as water, where the device acts as a brake or a steering mechanism.

In FIG. 2, the device 14 is illustrated for use in a barge 40. There are pontoons 42 with the cups 44 and 46. The cup 44 is an extended position, and the cup 46 is in a retracted position. The water flow is indicated by arrows 45 and 47. In this manner, the barge can be steered as indicated by arrow 48. In other forms when both of the cups 44 and 46 are retracted the cups can provide a braking action.

In FIG. 10, there is a ship or boat 140 with a reversible element 14 in the front. The two positions 114 and 142 are illustrated. This effects movement through water.

Although the hydro-resistive elements are illustrated as cup-shaped, hemispherical or cone shapes, dish shapes and other different hydro-resistive shapes including flat panels, or discs with or without perforated elements are possible. Also, different sized hydro-resistive elements, for instance, in the sense of diameter, can be used as required.

In the arrangement of FIG. 11, there is shown a baby high chair with reversible cups attached to the feet 212 of the chair so as to selectively cover or be removed form the wheels 210 and thereby permit control of the movement of the chair over a floor surface.

In FIG. 12, there is an embodiment for using a stirrup 156 and pulley system 150, 152 and 154 whereby different aquatic exercises can be effected. The device is mounted with plate 158 on a ridge 160 of a wall of a swimming pool. By changing the position of the reversible cup 14, different resistances can be provided to the device.

In some different applications, although the invention has been described as an aquatic exercise device, there may be applications for using the device as an exercise device in non-aquatic environments. In different forms of the invention, the reversible cup is reversed about the base. In other forms, the reversible cup is reversed about the rim. This latter reversible characteristic is illustrated in FIGS. 2 and 10.

As illustrated in the arrangement of FIG. 1, and in some of the other igures, the flexible cup is operable between the reversible modes both by action from the support attached to the base and/or by moving the perimeter of the cup with an activator 32.

In some other cases of operation of the cups with the system, it is possible to have the cups non-reversible in their operation. As such, in one of operating positions, the cup extends over an appendage to protect the appendage from interengagement with the surface. In other cases, the cup is effectively removed from the appendage so that there is interaction with the exterior. In other cases the appendage is an attachment means which does not protrude from the support, but alternatively has a recessed formation for receiving an element such as a spindle. In some cases the cup can additionally be removed from the support to effect the reversed positioning.

The invention is to be determined solely in terms of the following claims.

What is claimed is:

1. A device comprising:

a) a support;

b) a flexible substantially cup-shaped element operatively connected to the support; and c) the element including a base, a rim and a first axis extending from the center of the base to the center of an area enclosed by the rim and being configured to be reversible about an axis perpendicular to said first axis without being removed from the support, and to be operable for a first function in a first position with the base being affixed to the support and the rim extending from the support and located in a position removed from the support and operable for a second function in a reversed second position with the base affixed to the support and the rim located spaced from the support and surrounding the support.

2. A device as claimed in claim 1 wherein the support includes a first end and at least a second end, and wherein there are multiple elements, each respective element being reversible and operatively connected to the support.

3. A device as claimed in claim 1 wherein the element includes a radial member, the radial member being directed substantially along part of the first axis for the element, and the radial member being for anchoring engagement with the support.

4. A device as claimed in claim 1 wherein the support includes a longitudinal axis, and means with the support for facilitating relative rotation of the support and element about the longitudinal axis.

5. A device as claimed in claim 2 wherein the support includes a longitudinal axis, and means with the support for facilitating relative rotation of the support and element about the longitudinal axis.

6. A device as claimed in claim 2 including means for having the elements selectively locatable with the support in multiple operational modes, the modes being with the rim of the elements directed substantially toward the support, with the rim of the elements directed substantially away from the support, or with the rim of some of the elements directed substantially toward the support and the rim of other elements directed substantially away from the support.

7. A device comprising a support having a first end and a second end, a first flexible element operatively connected to the first end of the support and a second flexible element operatively connected to the second end of the support, wherein each element includes a base, a rim and a first axis extending from the center of base to the center of an area enclosed by the rim and at least one element is configured to be reversible about an axis perpendicular to said first axis and that intersects with said first axis at the center of the base without being removed from the support, wherein the element can adopt a respective first position with the base being affixed to the support and the rim extending from the support and located in a position removed from the support, and a second reversed position with the base affixed to the support and the rim located spaced from the support and surrounding the support.

8. A device comprising:

a) a support;

b) a flexible substantially cup-shaped element operatively connected to the support; and c) the element including a base, a rim and a first axis extending from the center of the base to the center of an area enclosed by the rim and being configured to be reversible about an axis perpendicular to said first axis without being removed from the support, and to be operable for a first function in a first position and a second function in a reversed second position, and wherein the element in the first position extends with the rim directed away from the support thereby to provide a first resistance to an engaging medium when the element moves relatively through the medium, and with the element in the second position, the element extends about the support with the rim around and spaced from the support thereby to provide a second different resistance to an engaging medium when the element moves relatively through the medium.

9. A device as claimed in claim 8 wherein the medium is selectively a liquid or a gas, and the support includes a first end and at least a second end.

10. A device as claimed in claim 8 wherein the support includes a first end and at least a second end, and wherein there are multiple elements, each respective element being reversible and operatively connected to the support.

11. A device as claimed in claim 8 including means for having the elements selectively locatable with the support in multiple operational modes, the modes being with the rim of the elements directed substantially toward the support, with the rim of the elements directed substantially away from the support, or with the rim of some of the elements directed substantially toward the support and the rim of other elements directed substantially away from the support.

12. A device as claimed in claim 11 wherein the multiple modes of the multiple elements act to permit different modes of interaction of the support with the medium.

13. A device as claim in claim 12 wherein the different modes of interaction are selectively braking or steering of the support in the medium.

14. A device comprising:

a) a support;

b) a flexible substantially cup-shaped element operatively connected to the support; and c) the element including a base, a rim and a first axis extending from the center of the base to the center of an area enclosed by the rim and being configured to be reversible about an axis perpendicular to said first axis without being removed from the support, and to be operable for a first function in a first position and a second function in a reversed second position, and wherein the element in a first position extends with the rim protruding from the support thereby to provide a first resistance to an engaging medium when the element moves relatively through the medium and the element in a second position extends with the rim retracted towards the support so as to surround the support and be spaced from the support thereby to provide a second resistance to an engaging medium when the element moves relatively through the medium.

15. An aquatic exercising device comprising:

a) a support having a first end and a second end;

b) a first flexible substantially cup-shaped hydro-resistive element operatively connected to the first end of the support;

c) a second flexible substantially cup-shaped hydro-resistive element operatively connected to the second end of the support; and d) each element including a base, a rim and a first axis extending from the center of the base to the center of an area enclosed by the rim and at least one element being configured to be reversible about an axis perpendicular to said first axis and that intersects with said first axis at the center of the base without being removed from the support, each element being operable for a first function in a first position and a second function in a reversed second position, and wherein the elements in a first position extend with the rims protruding in a first direction relative to the support thereby to provide a first resistance to water when the elements move relatively through the water and the elements in a second position extend with the rims directed differently relative to the support at least one of the rims being located in a position surrounding and spaced from the support thereby to provide a second resistance to the water when the elements move relatively through the water thereby to provide a different resistance in the water when used for exercising.

16. An exercising device comprising a support having a first end and a second end, a first flexible element operatively connected to the first end of the support and a second flexible element operatively connected to the second end of the support, wherein each element includes a base, a rim and a first axis extending from the center of base to the center of an area enclosed by the rim and at least one element is configured to be reversible about an axis perpendicular to said first axis and that intersects with said first axis at the center of the base without being removed from the support, such as to adopt selectively one of two positions, wherein in a first position the base is affixed to the support and the rim extends from the support and removed from the support, and in the second reversed position each base is affixed to the support and each rim is located spaced from and surrounds the support, thereby to provide different resistance for exercising.

17. A device as claimed in claim 15 wherein the support includes a first end and at least a second end, and wherein there are multiple elements, each respective element being reversible and operatively connected to the support.

18. A device as claimed in claim 16 including means for having the elements selectively locatable with the support in multiple operational modes, the modes being with the rim of the elements directed relative to the support with the rim of the elements directed in one direction relative to the support, or with the rim of one of the elements directed relatively in another direction relative to the support and the rim of other elements directed substantially away from the support.

19. A device comprising:

a) a support;

b) a flexible impermeable substantially cup-shaped element operatively connected to the support; and c) the element including a base, a rim and a first axis extending from the center of the base to the center of an area enclosed by the rim and being configured to be reversible about an axis perpendicular to said first axis without being removed from the support, and to be operable for a first function in a first position with the base projecting in a first direction from the support and operable for a second function in at least a partially reversed position with the base extending oppositely to the first position relative to the support.

20. A device as claimed in claim 1 wherein the cup shaped element is impermeable.

21. A device as claimed in claim 7 wherein the cup shaped elements are impermeable.

22. A device as claimed in claim 8 wherein the cup shaped element is impermeable.

23. A device as claimed in claim 14 wherein the cup shaped element is impermeable.

24. A device as claimed in claim 15 wherein the cup shaped elements are impermeable.

25. A device as claimed in claim 16 wherein the cup shaped elements are impermeable.

* * * * *

UNITED STATES PATENT AND TRADEMARK OFFICE
CERTIFICATE OF CORRECTION

PATENT NO. : 5,591,110

DATED : January 7, 1997

INVENTOR(S) : Weissbuch

It is certified that error appears in the above-identified patent and that said Letters Patent is hereby corrected as shown below:

Column 4, line 16, delete "or" and insert --for--.

Column 5, line 38, delete "the" after the letter "a".

Column 6, line 1, delete "the" after the letter "a".

Column 6, line 20, after the numeral "98" insert --that--.

Column 7, line 34, after the word "is" insert --in--.

Column 7, line 50, delete "form" and insert -- from--.

Column 9, line 50, delete "claim" and insert --claimed--.

Column 10, claim 16, line 42, after the word "of" (1st occur.) insert --the--.

Signed and Sealed this

Thirtieth Day of September, 1997

*Attest:*

*Attesting Officer*

Bruce Lehman

BRUCE LEHMAN

*Commissioner of Patents and Trademarks*